US006413350B1

(12) United States Patent
Boschi

(10) Patent No.: US 6,413,350 B1
(45) Date of Patent: Jul. 2, 2002

(54) METHOD AND DEVICE FOR FITTING PULL-OFF TABS TO POURABLE FOOD PRODUCT PACKAGING MATERIAL

(75) Inventor: Alessandro Boschi, Gualtieri (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/546,629

(22) Filed: Apr. 10, 2000

(30) Foreign Application Priority Data

Jun. 30, 1999 (EP) ..... 99830413

(51) Int. Cl.[7] ..... B32B 31/00

(52) U.S. Cl. ..... 156/272.2; 53/412; 53/451; 156/273.7; 156/273.9; 156/274.4; 156/275.1

(58) Field of Search ..... 220/270, 359.2; 53/412, 451, 551, 554; 156/272.2, 273.7, 273.9, 274.4, 275.1

(56) References Cited

U.S. PATENT DOCUMENTS 4,266,993 A 5/1981 Olsen ..... 156/69
4,585,498 A * 4/1986 Lagerstedt et al. ..... 156/274.4
5,310,262 A 5/1994 Robinson et al. ..... 383/205
6,009,925 A * 1/2000 Hall et al. ..... 156/274.4

FOREIGN PATENT DOCUMENTS

EP 0 149 130 12/1984
EP 0 368 168 11/1989

* cited by examiner

*Primary Examiner*—Jeff H. Aftergut
(74) *Attorney, Agent, or Firm*—Burns, Doane, Swecker & Mathis, L.L.P.

(57) ABSTRACT

A method of fitting pull-off tabs (2), made of heat-seal material, to strip packaging material (4) having a number of through openings (3) and covered, on the opposite side to that to which the tabs (2) are fitted, with at least a first and a second lamination layer (10, 11, 12, 9) made respectively of heat-seal material and electrically conducting material and covering the openings (3); the method including the step of joining each tab (2) to the packaging material (4) at a respective opening (3) by simultaneously performing hot-plate sealing and induction sealing operations. (FIG. 1)

6 Claims, 3 Drawing Sheets

METHOD AND DEVICE FOR FITTING PULL-OFF TABS TO POURABLE FOOD PRODUCT PACKAGING MATERIAL

BACKGROUND OF THE INVENTION

Field of the Invention

The present invention, relates to a method and device for fitting pull-off tabs to pourable food product packaging material.

DESCRIPTION OF THE RELATED ART

Many pourable food products, such as fruit juice, UHT (ultra-high-temperature treated) milk, wine, tomato sauce, etc., are sold in packages made of sterilized packaging material.

A typical example of such a package is the parallelepipedal package for liquid or pourable food products known as Tetra Brik Aseptic (registered trademark), which is formed by folding and sealing laminated strip packaging material. The packaging material has a multilayer structure comprising a layer of fibrous material, e.g. paper, covered on both sides with layers of heat-seal plastic material, e.g. polyethylene. In the case of aseptic packages for long-storage products such as UHT milk, the packaging material comprises a layer of barrier material, e.g. an aluminium film, which is superimposed on a layer of heat-seal plastic material and in turn covered with another layer of heat-seal plastic material defining the inner face of the package eventually contacting the food product.

As is known, packages of the above type are produced on fully automatic packaging machines, on which a continuous tube is formed from the packaging material supplied in strip form. The strip of packaging material is sterilized on the packaging machine, e.g. by applying a chemical sterilizing agent, such as a hydrogen peroxide solution; following sterilization, the sterilizing agent is removed, e.g. vaporized by heating, from the surfaces of the packaging material; and the strip of packaging material so sterilized is kept in a closed sterile environment, and is folded and sealed longitudinally to form a vertical tube.

The tube is filled with the sterilized or sterile-processed food product, and is sealed at equally spaced cross sections at which it is then cut into pillow packs, which are subsequently folded mechanically into finished, e.g. substantially parallelepipedal packages.

The finished package has a pull-off tab which is fitted to the packaging material before the material is sterilized and folded and sealed to form the vertical tube.

More specifically, a through opening is first formed in the packaging material at a cutting station. A so-called "patch", defined by a small sheet of heat-seal plastic material, is then heat-sealed over the opening, on the side of the packaging material eventually defining the inside of the package—this is done at two successive sealing stations to prevent overheating. And at this point, the pull-off tab is fitted to the opposite side of the packaging material and heat-sealed to the patch at a further sealing station.

The tab comprises a layer of aluminium and a layer of heat-seal plastic material, normally polyethylene, which is sealed to the patch. By virtue of the tab and patch adhering to each other, the portion of the patch sealed to the tab is removed together with the tab, thus uncovering the opening, when the tab is pulled off.

The patch and tab are normally heat-sealed to each other using a so-called "hot-plate sealing" process, whereby the patch and tab are blown by compressed air against a heated plate.

Alternatively, as described for example in Patent EP-B-149130 filed by the present Applicant, a heat-seal process commonly known as "induction sealing" is also used, whereby the packaging material at the opening is pressed between a heating element on the patch side and a backing plate on the tab side. The heating element comprises a central compressed-fluid, e.g. compressed-air, supply conduit to push the patch onto the tab and against the backing plate; and an inductor inserted in the work surface of the heating element to induce an electric current in the material held by the compressed fluid against the backing plate.

In short, regardless of the sealing technique used, the above method therefore consists in removing portions of the packaging material to form the openings, and then "repairing" the packaging material by applying the patches, thus resulting in poor efficiency and relatively high cost.

Moreover, though ensuring troublefree opening of the packages, the above method poses several problems as regards the integrity of the packages, and in particular as a result of the superheated patch interacting with the normally jagged edges of the opening formed in the layer of fibrous material.

One possible alternative is to form the through opening directly in the layer of fibrous material of the packaging material before the fibrous layer is combined with the plastic and aluminium layers, hereinafter referred to simply as "lamination layers."

At the end of the lamination process, therefore, the opening is covered by the lamination layers; the package is perfectly integral; and no patch is required.

As in the previous case, the tab is fitted to the side of the packaging material eventually defining the outside of the package, and is sealed to the layer of plastic material covering the opening.

To ensure troublefree opening of the packages, the tab and the lamination layers sealed to it must adhere firmly. In the case in question, however, the degree of adhesion provided for by conventional heat-seal methods as described above is fairly poor, so that, when the tab is pulled off, parts of the lamination layers remain inside the opening, thus preventing smooth outflow of the food product through the opening.

Brief Summary of the Invention

It is an object of the present invention to provide a method of fitting pull-off tabs to pourable food product packaging material, designed to eliminate the aforementioned drawbacks typically associated with known methods.

According to the present invention, there is provided a method of fitting pull-off tabs, made of heat-seal material, to strip packaging material having a number of through openings and covered, on the opposite side to that to which said tabs are fitted, with at least a first and a second lamination layer made respectively of heat-seal material and electrically conducting material and covering said openings; the method being characterized by comprising the step of joining each said tab to said packaging material at at least one respective said opening by simultaneously performing hot-plate sealing and induction sealing operations.

According to the present invention, there is also provided a device for fitting pull-off tabs, made of heat-seal material, to strip packaging material having a number of through openings and covered, on the opposite side to that to which said tabs are fitted, with at least a first and a second lamination layer made respectively of heat-seal material and electrically conducting material and covering said openings;

the device being characterized by comprising hot-plate sealing means and induction sealing means, which are activated simultaneously to join each said tab to said packaging material at at least one respective said opening.

BRIEF DESCRIPTION OF THE SEVERAL VIEWS OF THE DRAWINGS

A preferred, non-limiting embodiment of the present invention will be described by way of example with reference to the accompanying drawings, in which.

DETAILED DESCRIPTION OF THE INVENTION

Figures 1, 3:
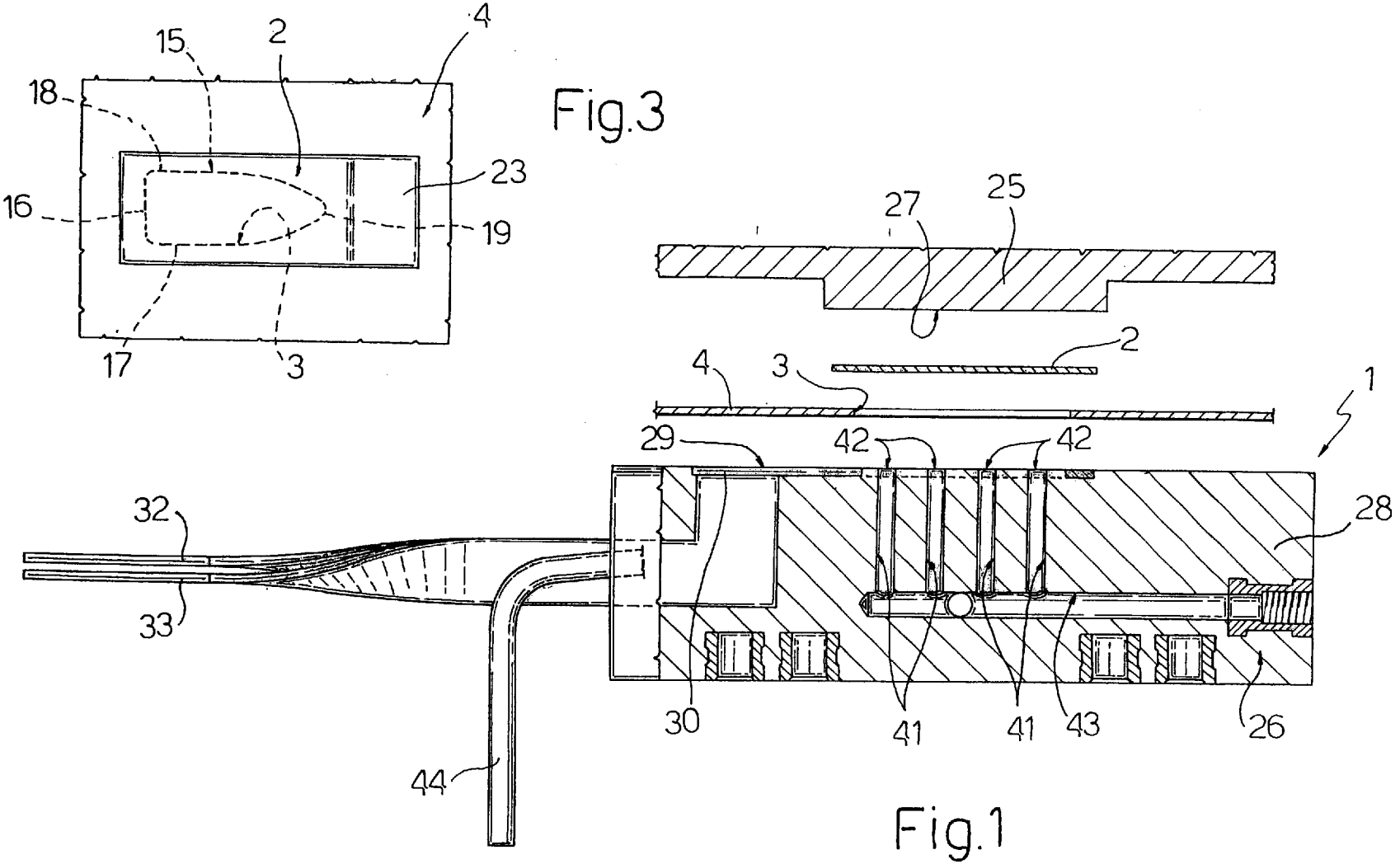
FIG. 1 shows an exploded section of a device in accordance with the present invention for fitting pull-off tabs to pourable food product packaging material.
FIG. 3 shows a plan view of a portion of packaging material fitted with a respective pull-off tab.
Figure 2:
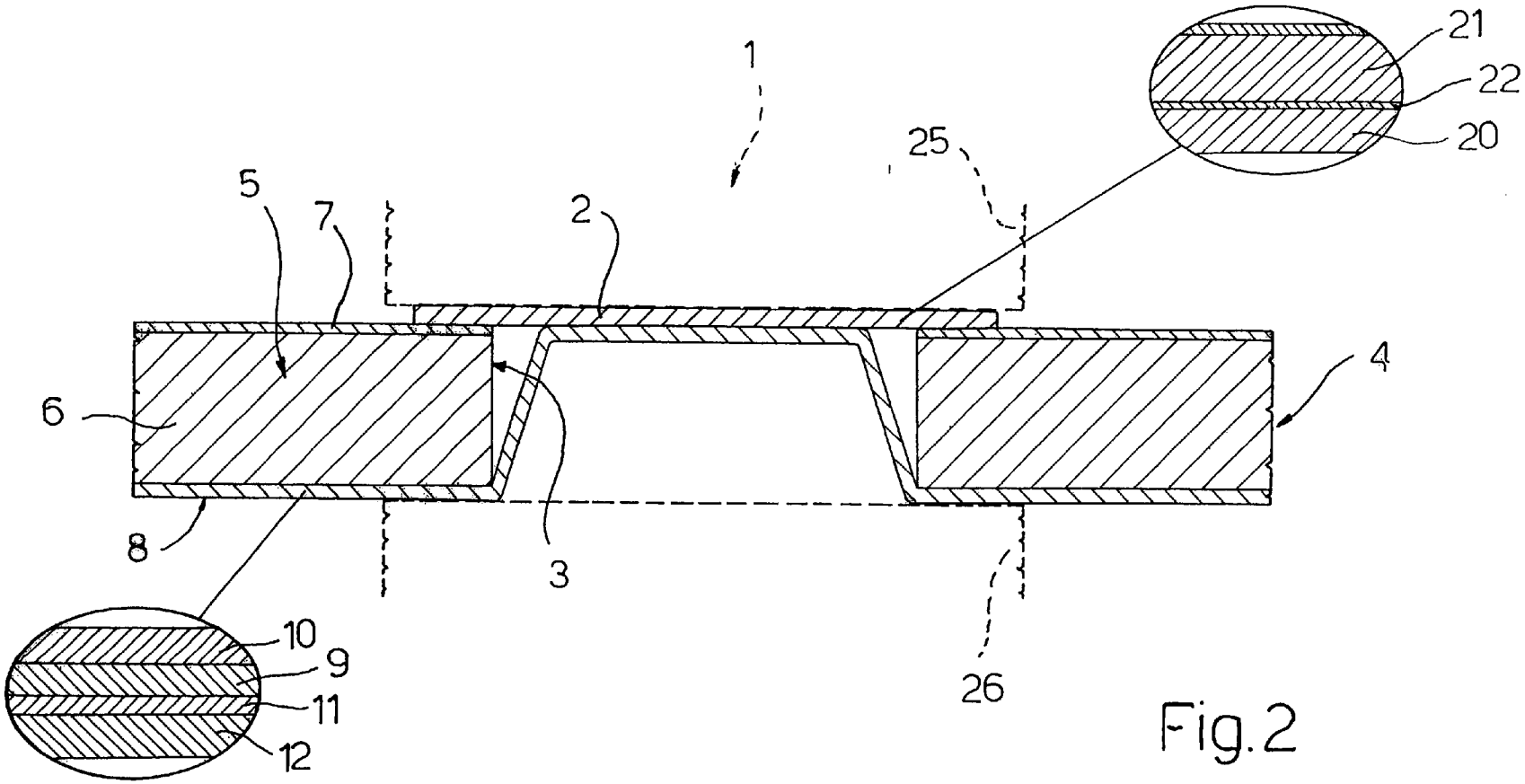
FIG. 2 shows a larger-scale schematic section of the FIG. 1 device in the work position, and the component layers of the packaging material and pull-off tab.

Number 1 in FIGS. 1 and 2 indicates as a whole a device in accordance with the present invention for fitting pull-off tabs 2 over respective openings 3 (only one shown) formed in strip packaging material 4.

Device 1 may be incorporated in a packaging unit (not shown) for continuously forming, from packaging material 4, aseptic sealed packages containing a pourable food product such as pasteurized or UHT milk, fruit juice, wine, etc. In particular, packaging material 4 is folded and sealed longitudinally in known manner to form a vertical tube, which is filled with the sterilized or sterile-processed food product for packaging, is sealed along equally spaced cross sections, and undergoes successive mechanical folding operations to form the finished packages.

Device 1 is located along the supply path of packaging material 4, upstream from a station at which the vertical tube is formed.

With particular reference to FIG. 2, packaging material 4 supplied to device 1 has a multilayer structure, and comprises a main sheet 5 having openings 3 and defined by a layer 6 of fibrous material, e.g. paper, covered, on the side eventually defining the outer face of the packages, with a film 7 of heat-seal plastic material—in the example shown, polyethylene.

On the side eventually defining the inner face of the packages, main sheet 5 is covered with a lamination sheet 8 covering openings 3.

Lamination sheet 8 comprises a layer 9 of electrically conducting barrier material defined, for example, by an aluminium film, which is covered on both sides with respective layers 10, 11 of heat-seal plastic material such as polyethylene. In the example shown, layer 11 is covered, on the opposite side to that contacting layer 9 of barrier material, with a further layer 12 of heat-seal plastic material, normally polyethylene.

The dash line in FIG. 3 indicates the lateral edge 15 of an opening 3 formed in packaging material 4, and which may comprise a single hole through which to pour the product, or two holes: one through which to pour the product, and one, normally smaller, which acts as an air inlet. Lateral edge 15 may, for example, be substantially ogival, and comprises a straight end side 16 perpendicular to supply path P of packaging material 4, and two curved longitudinal sides 17, 18 extending perpendicularly from respective opposite ends of end side 16, having respective concavities facing each other, and converging to form a rounded end vertex 19 at the opposite end to end side 16.

Each tab 2 is rectangular and projects outwards with respect to respective opening 3.

Each tab 2 also has a multilayer structure, and comprises a layer 20 of heat-seal plastic material, e.g. polyethylene, one face of which is eventually joined to lamination sheet 8 at respective opening 3, and to film 7 of packaging material 4 in the region surrounding opening 3; and a layer 21 of barrier material, normally aluminium, which is fixed to layer 20 of heat-seal plastic material by an intermediate layer 22 of adhesive on the opposite side to lamination sheet 8.

At the same end as vertex 19 of respective opening 3, each tab 2 comprises a grip portion 23 by which to tear open the package, and which is detached from film 7 of packaging material 4.

One important aspect of the present invention lies in device 1 comprising a first hot-plate sealing member 25 and a second induction sealing member 26 located on opposite sides of packaging material 4, and which are activated simultaneously to interact with and heat seal layers 9, 10, 11, 12 of lamination sheet 8, respective tab 2 and film 7 of packaging material 4 at each opening 3.

Sealing members 25, 26 are moved towards each other by respective known guide members not shown.

Sealing member 25 comprises a preheated plate preferably made of ceramic material—in the example shown, aluminium oxide—coated externally with non-stick material substantially with a chromium- and titanium-nitride base.

Sealing member 25 is located on the tab 2 side, and cooperates with tab 2 by means of a respective flat work surface 27 parallel to path P.

Figure 4:
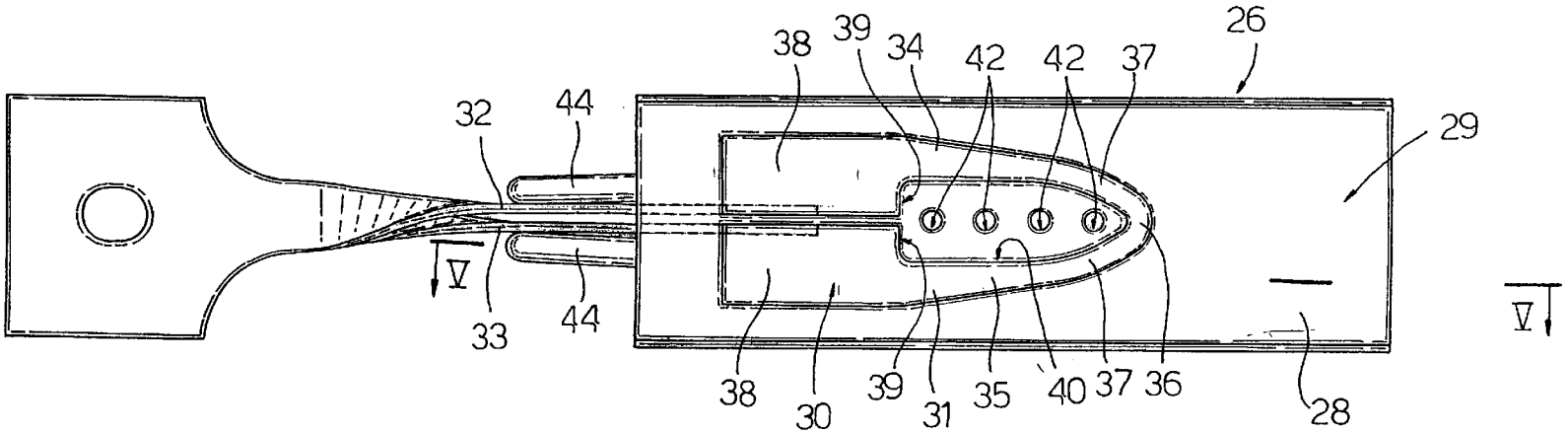
FIG. 4 shows a side view of an induction heating element of the FIG. 1 device.
Figure 5:
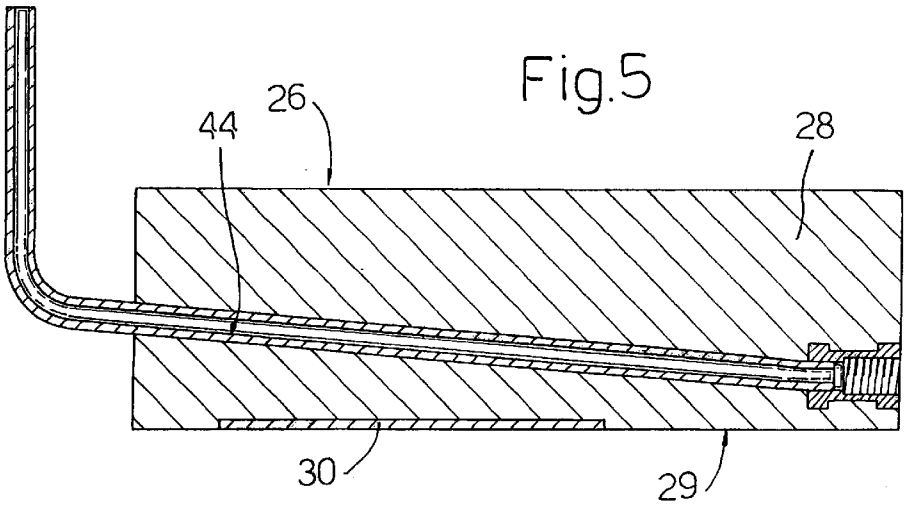
FIG. 5 shows a section along line V—V in FIG. 4.

With reference to FIGS. 1, 4 and 5, sealing member 26 substantially comprises a body 28 made of electrically insulating material and substantially in the form of a parallelepiped elongated parallel to path P; and an inductor 30 located on a flat lateral surface 29 of body 28, which surface 29 is parallel to surface 27 of sealing member 25 and interacts with lamination sheet 8 of packaging material 4.

In particular, inductor 30 comprises a single flat turn 31 housed in a respective groove on surface 29 and defined by a substantially C-shaped conducting plate with closely spaced free ends connected respectively to a first and second terminal 32, 33 in turn connectable to a drive circuit (not shown) for supplying inductor 30 with high-frequency electric current.

With particular reference to FIG. 4, turn 31 is so formed as to extend substantially around lateral edge 15 of opening 3 with which it is designed to interact, and is defined by two substantially curved branches 34, 35, which extend symmetrically on opposite sides of an intermediate plane perpendicular to packaging material 4 and to surface 29, and which are joined at a rounded vertex portion 36.

In particular, branches 34, 35 are defined by thin, flat, curved strips 37 terminating with respective flat, rectangular end portions 38, which define the free ends of turn 31 and extend towards each other to define respective coplanar shoulders with respective strips 37. Strips 37 and end portions 38 of branches 34, 35 of turn 31 interact respectively with longitudinal sides 17, 18 and end side 16 of respective opening 3, while vertex portion 36 interacts with vertex 19 of opening 3.

Branches 34, 35 define in between a substantially ogival region 40 of surface 29, which region has an outer contour similar to that of lateral edge 15 of each opening 3, but is smaller than opening 3 (FIG. 4).

The transverse dimensions of strips 37 of branches 34, 35 are smaller-than those of respective end portions 38, and decrease gradually to minimum values at vertex portion 36.

Sealing member 26 also comprises a number of conduits 41 for directing compressed fluid—in the example shown, compressed air—onto lamination sheet 8, so as to push the lamination sheet, in use, onto tab 2, and both the lamination sheet and the tab against sealing member 25. Conduits 41 extend parallel to one another inside body 28, terminate with respective outlet holes 42 in region 40 of surface 29 of sealing member 26, and are connected to a common supply conduit 43 extending longitudinally through body 28 and in turn connectable to a pressurized-fluid source (not shown).

To prevent overheating induction sealing member 26, body 28 is fitted through with a pair of cooling conduits 44 supplied with cooling fluid.

For the sake of simplicity, operation of device 1 will be described with reference to the application of one pull-off tab 2 over a respective opening 3 in packaging material 4.

In particular, when tab 2 and opening 3 are positioned correctly between sealing members 25, 26, sealing members 25, 26 are brought together to press the the various layers of material in between.

At the same time, inductor 30 is supplied with high-frequency electric current, and compressed fluid is fed along conduits 41 into the region between sealing members 25, 26 to push lamination sheet 8 onto tab 2 and against the preheated sealing member 25.

Supply of inductor 30 induces electric current in the barrier material layer 9 of lamination sheet 8, thus heating lamination sheet 8; and the synergic effect of the heating action of sealing members 25, 26 on lamination sheet 8, tab 2 and packaging material 4—maintained contacting one another by the thrust exerted by the compressed fluid—causes film 7 of packaging material 4 and layer 20 of tab 2 to fuse in the region surrounding opening 3, and layer 20 of tab 2 and layer 10 of lamination sheet 8 to fuse in the area of opening 3 itself.

By virtue of the particular shape of turn 31, the current induced in lamination sheet 8 provides for greater heating of the area around lateral edge 15 of opening 3 and, hence, improved sealing of tab 2 and lamination sheet 8. Moreover, since the transverse dimensions of turn 31 are minimum at vertex portion 36, and since the temperature obtainable by electric current induction in a portion of material is inversely proportional to the inductor cross section facing the material portion, the portion of opening, 3 close to vertex 19—where pull-off of tab 2 is initiated—is a, heated to a higher temperature than elsewhere, thus resulting in greater adhesion of lamination sheet 8 and tab 2 and, hence, in improved opening of the packages as compared with traditional sealing methods.

The advantages of device 1 and the method according to the present invention will be clear from the foregoing description.

In particular, tests have shown that combined induction and hot-plate sealing provides for excellent adhesion of tabs 2 and lamination sheet 8 of packaging material 4. This is mainly due to the design of inductor 30, which makes maximum use of the high-frequency electric current effect on the edges of packaging material 4, so as to achieve greater heating around lateral edges 15 of openings 3, with maximum temperatures at the portions where pull-off of tabs 2 is initiated.

The ease with which the packages formed from packaging material 4 are opened is therefore at least comparable to that achievable by methods employing patches inside the packages, but with no patches required. Eliminating the patches in turn provides for reducing the amount of processing required by packaging material 4 on the packaging machine, and in particular for eliminating the cutting station for forming the through openings in the packaging material, the sealing stations for sealing the patches to the packaging material, collection of the waste material, and storage of the patches themselves. Main sheet 5 of packaging material 4 may therefore be punched and covered with lamination sheet 8 directly at the paper mill.

All of which obviously provides for speeding up production of the packages.

Moreover, downtime of the machine, caused by non-sterile packages resulting from improper application of the patches, is also reduced.

Clearly, changes may be made to device 1 as described and illustrated herein without, however, departing from the scope of the accompanying claims.

What is claimed is:

1. A method of fitting pull-off tabs (2) made of heat-seal material to strip packaging material, the method comprising:

providing the pull-off tabs;

providing the strip packaging material(4) having a number of through openings (3) and covered, on an opposite side to that to which said tabs (2) are fitted, with at least a first and a second lamination layer (10, 11, 12, 9) made respectively of heat-seal material and electrically conducting material and covering said openings (3) wherein said first and second lamination layers are separate from said strip packaging material; and joining each said tab (2) to said strip packaging material (4) at said openings (3) by simultaneously performing hot-plate sealing and induction sealing operations.

2. A method as claimed in claim 1, characterized in that said hot-plate sealing operation further comprises a step of pushing, at each said opening (3), said first and second lamination layer (10, 11, 12, 9) and said tab (2) into contact with each other and against a preheated backing member (25).

3. A method as claimed in claim 2, characterized in that said pushing step is performed by directing compressed fluid into an area of each said opening and towards said first and second lamination layer (10, 11, 12, 9) to push the first and second lamination layer into contact with said tab (2) and against said preheated backing member (25) located on an opposite side of said tab (2).

4. A method as claimed in claim 1, characterized in that said induction sealing operation is performed by inducing a high-frequency electric current in said second lamination layer (9) to produce, in said strip packaging material (4) and in each said tab (2) contacting each other, an increase in temperature which is greater around a lateral edge (15) of the respective said opening (3) than at other parts of the opening (3).

5. A method as claimed in claim 4, characterized in that said increase in temperature produced by said induction sealing operation reaches maximum values at an end portion (19) of said lateral edge (15) of each said opening (3)

defining the portion at which the pull-off of the respective said tab (2) is initiated.

6. A method as claimed in claim 5, characterized in that said induction sealing operation is performed by means of an inductor (30) comprising at least one turn (31) extending substantially around said lateral edge (15) of the respective said opening (3) and having a cross section at said end portion (19) of said lateral edge (15) of said opening (3).

* * * * *